United States Patent [19]

Nakata et al.

[11] Patent Number: 4,720,862

[45] Date of Patent: Jan. 19, 1988

[54] METHOD AND APPARATUS FOR SPEECH SIGNAL DETECTION AND CLASSIFICATION OF THE DETECTED SIGNAL INTO A VOICED SOUND, AN UNVOICED SOUND AND SILENCE

[75] Inventors: Kazuo Nakata, Kodaira; Takanori Miyamoto, Kokubunji, both of Japan

[73] Assignee: Hitachi, Ltd., Tokyo, Japan

[21] Appl. No.: 462,015

[22] Filed: Jan. 28, 1983

[30] Foreign Application Priority Data

Feb. 19, 1982 [JP] Japan ..... 57-24388

[51] Int. Cl.[4] ..... G10L 5/00

[52] U.S. Cl. ..... 381/38

[58] Field of Search ..... 381/41, 42, 43, 44, 381/45, 46, 47, 48, 49, 50, 36–40; 364/513.5, 513

[56] References Cited

U.S. PATENT DOCUMENTS

| | | | |
|---|---|---|---|
| 3,979,557 | 9/1976 | Schulman et al. | 381/49 |
| 4,074,069 | 2/1978 | Tokura et al. | 381/41 |
| 4,081,605 | 5/1978 | Kitawaki et al. | 381/49 |
| 4,297,533 | 10/1981 | Gander et al. | 381/46 |
| 4,301,329 | 11/1981 | Taguchi | 381/37 |
| 4,360,708 | 11/1982 | Taguchi et al. | 381/36 |
| 4,390,747 | 6/1983 | Sampei et al. | 381/49 |
| 4,401,849 | 8/1983 | Ichikawa et al. | 381/46 |

OTHER PUBLICATIONS

David, E. E. et al, "Note on Pitch Synchronous Processing of Speech" monograph by Bell Telephone System Technical Publications, 1955.

Rabiner, L. R. et al, "Digital Processing of Speech Signals" (Bell Labs, Incorporated, 1978), TK 7882.S65 R3, pp. 401–413.

*Primary Examiner*—Emanuel S. Kemeny

*Attorney, Agent, or Firm*—Antonelli, Terry & Wands

[57] ABSTRACT

A method and apparatus for speech signal detection and classification in which a partial auto-correlation and residual power analyzation circuit extracts a normalized first-order partial auto-correlation coefficient and $K_1$ a normalized zero-order residual power $E_N$ from an input signal, and a sound source analyzation circuit extracts a normalized residual correlation $\phi$ from the input signal, and in which on the basis of these extracted parameters, speech signals are detected, and, when so detected, the detected speech signals are classified into a voiced sound V, an unvoiced sound U and silence $\bar{S}$. The classification of the respective voiced sound, unvoiced sound and silence is determined on the basis of preset threshold values that are mutually considered and which correspond to values of these extracted $K_1$, $E_N$ and $\phi$ parameters for establishing boundary values for classifying the input signals into a voiced sound, an unvoiced sound or silence.

9 Claims, 9 Drawing Figures

METHOD AND APPARATUS FOR SPEECH SIGNAL DETECTION AND CLASSIFICATION OF THE DETECTED SIGNAL INTO A VOICED SOUND, AN UNVOICED SOUND AND SILENCE

BACKGROUND OF THE INVENTION

1. Field of the Invention

This invention relates to a method and apparatus for speech signal detection in speech analysis and for decision and classification as to whether the detected speech signal is voiced or unvoiced. More particularly, this invention relates to a method and apparatus which are suitable for reliably executing the detection and classification without dependence upon the level of a speech input.

2. Description of the Prior Art

The most fundamental step of processing in speech analysis for the purpose of speech synthesis or recognition includes detection of a speech signal and decision and classification as to whether the detected speech signal is voiced or unvoiced. Unless this processing step is accurately and reliably done, the quality of synthesized speech will be degraded or the error rate of speech recognition will increase.

Generally, for the detection and classification of a speech signal, the intensity of a speech input (the mean energy in each of the analyzing frames) is the most important and decisive factor. However, use of the absolute value of the intensity of the speech input is undesirable because the result is dependent upon the input condition. In the prior art off-line analysis (for example, analysis for speech synthesis), such a problem has been dealt with by the use of the intensity normalized by the maximum value of the mean energy in individual frames of a long speech period (for example, the total speech period of a single word). However, such a manner of analysis has been defective in that it cannot deal with the requirement for real-time speech synthesis or recognition.

SUMMARY OF THE INVENTION

With a view to solve the prior art problem, it is a primary object of the present invention to provide a method an apparatus for detecting a speech signal and deciding whether the detected speech signal is voiced or unvoiced, which can function reliably even in the case of real-time analysis without dependence upon the intensity or amplitude of the speech input.

The present invention which attains the above object is featured by the fact that three kinds of parameters which are not dependent upon relative level variations of intensity or amplitude of a speech input signal are extracted from the input speech signal, and, on the basis of the physical meanings of these parameters, the process of speech signal detection and decision and classification as to whether the detected speech signal is voiced or unvoiced is executed.

DESCRIPTION OF THE PREFERRED EMBODIMENTS

In the usual analysis of speech, one data block includes data applied within a period of time of 20 msec to 30 msec, and such data blocks are analyzed at time intervals of 10 msec to 20 msec. Among principal normalized parameters extracted from one block of data, the following three parameters are especially important in relation to the present invention:

(1) $k_1=\gamma_1/\gamma_o$; first-order partial auto-correlation coefficient ($\gamma_o$ and $\gamma_1$ are the zero-order and first-order auto-correlation coefficients respectively.) $K_1$ can thus be considered as a normalized first-order auto-correlation coefficient since $\gamma_i$ is divided by $\gamma_o$.

(2)

$$En = \prod_{i=1}^{p} (1 - k_i^2);$$

normalized residual power (p is the order of analysis.)

(3) $\phi$; peak value of normalized residual correlation.

Figure 1:
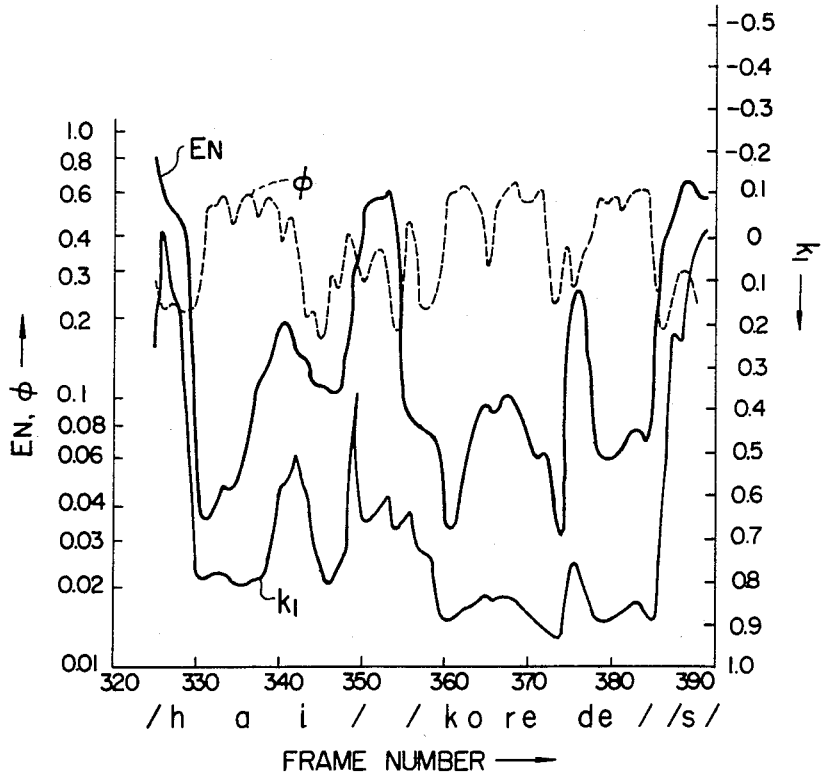
FIGS. 1 and 2 show examples of the analytical results of extraction of normalized parameters ($k_1$, $E_N$ and $\phi$) which are fundamental factors utilized in the method and apparatus of the present invention.
Figure 2:
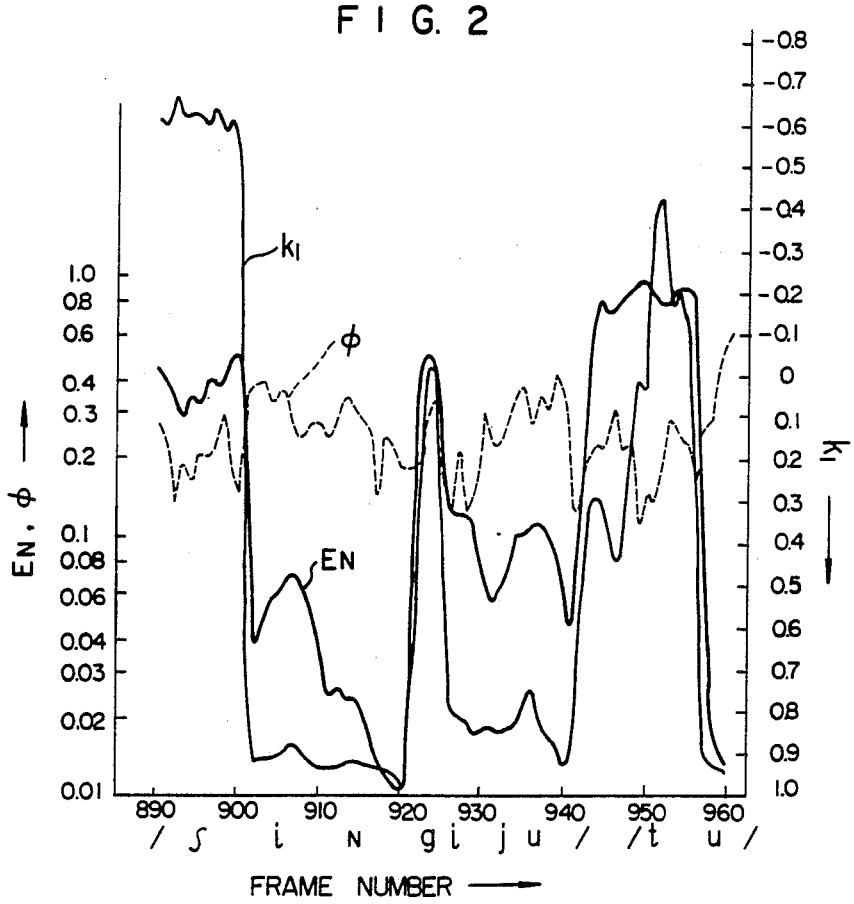

All of the values of these parameters are normalized and are not primarily dependent upon intensity or amplitude of input speech signals. Examples of practical values of these parameters are shown in FIGS. 1 and 2. FIG. 1 represents the case of male voice, and FIG. 2 represents the case of female voice.

Figure 3:
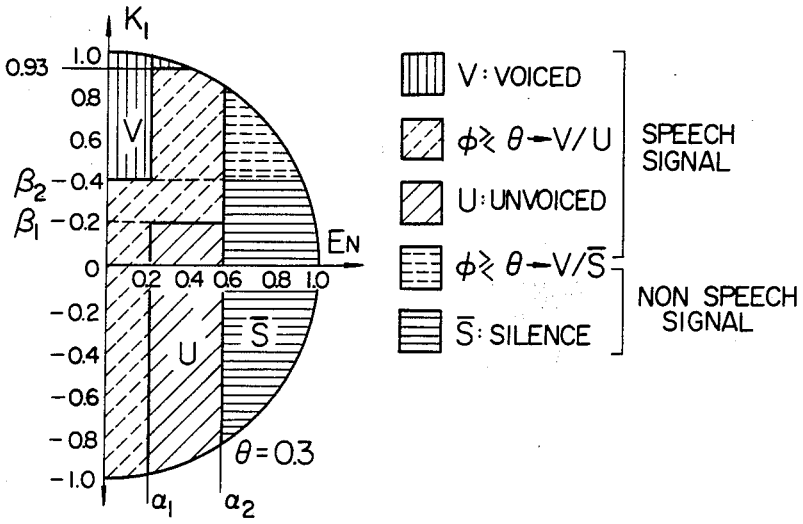
FIG. 3 illustrates the principle of speech signal detection and decision and classification according to the present invention.

From these many analytical results and also from the physical meanings of the individual parameters, a detection and classification algorithm as shown in FIG. 3 can be considered. In FIG. 3, $\phi \gtrless \theta \rightarrow V/U$ (or $V/\bar{S}$) indicates that speech is decided to be V (or V) when $\phi > \theta$ and to be U (or $\bar{S}$) when $\phi < \theta$, respectively. In the above expression the symbols, V, U and $\bar{S}$ represent a voiced sound, an unvoiced sound and silence respectively, and $\theta$ represents a particular value of the normalized residual correlation corresponding to a threshold value.

The symbols $\alpha_1$ and $\alpha_2$ in FIG. 3 are threshold values pre-set for the purpose of decision relative to the parameter $E_N$, and $\beta_1$ and $\beta_2$ are those pre-set for the purpose of decision relative to the parameter $k_1$. For example, their values are as follows:

$$\alpha_1=0.2,\ \alpha_2=0.6,$$

$$\beta_1=0.2,\ \beta_2=0.4$$

Figure 4:
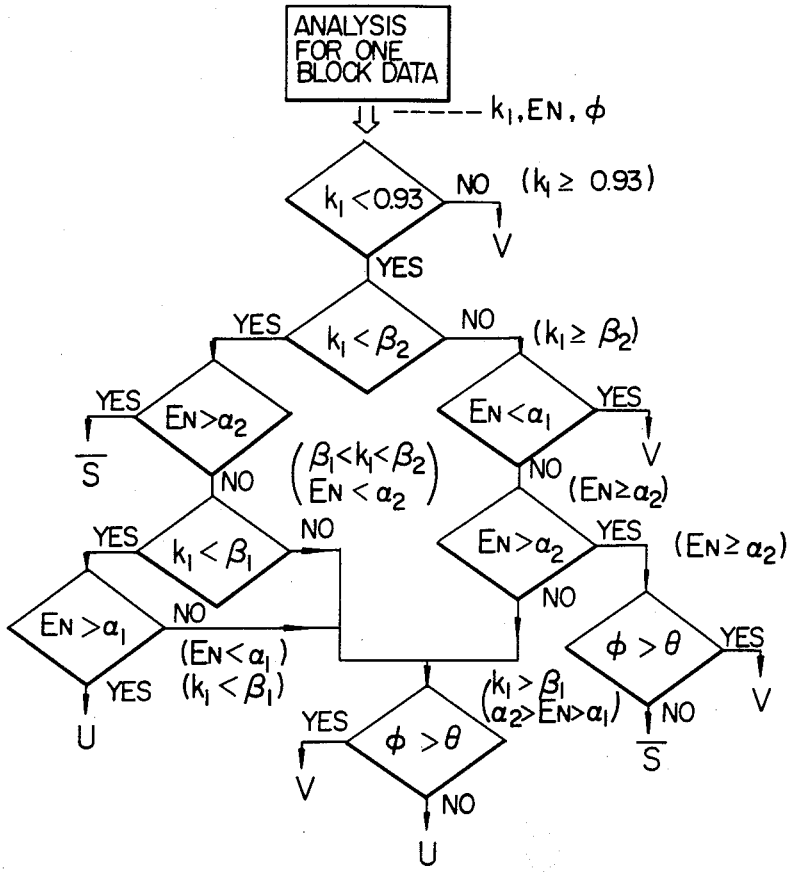
FIG. 4 is a flow chart of the process for speech signal detection and decision and classification of one embodiment of the invention according to the principle illustrated in FIG. 3.

FIG. 4 is a flow chart of the process for one embodiment of the present invention classifying a speech input into one of the voiced sound (V), unvoiced sound (U) and silence ($\bar{S}$) on the basis of the algorithm shown in FIG. 3.

An embodiment of the present invention will now be described in detail.

Figure 5:
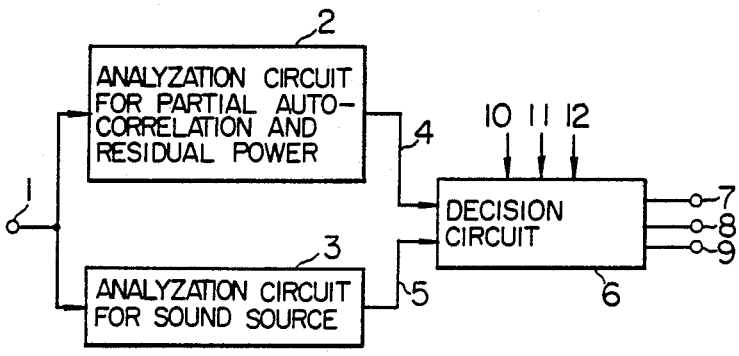
FIG. 5 is a block diagram of an embodiment of the apparatus according to the present invention.

FIG. 5 is a block diagram showing the structure of one form of a speech synthesis apparatus based on the method of the present invention.

Referring to FIG. 5, a speech signal waveform 1 representing one block of data is applied to two analyzation circuits 2 and 3. The analyzation circuit 2 computes partial auto-correlation coefficients $k_1, k_2, \ldots, k_p$ and normalized zero-order residual power $E_N$ by partial auto-correlation analysis, and the manner of processing therein is commonly known in the art. (For details, reference is to be made to a book entitled "Voice" 1977, chapter 3, 3.2.5 and 3.2.6, written by K. Nakata (published by Coronasha in Japan) or a book entitled "Speech Processing by Computer" 1980, Chapter 2, written by Agui and Nakajima (published by Sanpo Shuppan in Japan).

An output 4 indicative of $k_1$ and $E_N$ appears from the analyzation circuit 2 to be applied to a decision circuit 6.

The other analyzation circuit 3 is a sound source analyzation circuit which computes the normalized residual correlation $\phi$. The manner of processing therein is also commonly known in the art, and reference is to be made to the two books cited above. An output 5 indicative of $\phi$ appears from the analyzation circuit 3 to be applied to the decision circuit 6.

The decision circuit 6 makes a decision or classification of the inputs 4 and 5 by comparing them with predetermined threshold values 10, 11 and 12 according to the logic shown in FIG. 3, that is, according to the flow chart shown in FIG. 4. Such processing can be easily executed by use of, for example, a microprocessor. Outputs representative of V (a voiced sound), U (an unvoiced sound) and $\bar{S}$ (silence) appear at output terminals 7, 8 and 9, respectively, of the decision circuit 6.

Upon completion of processing of one block of data, processing of the next data block is started, and such cycles are repeated thereafter.

Figure 6:
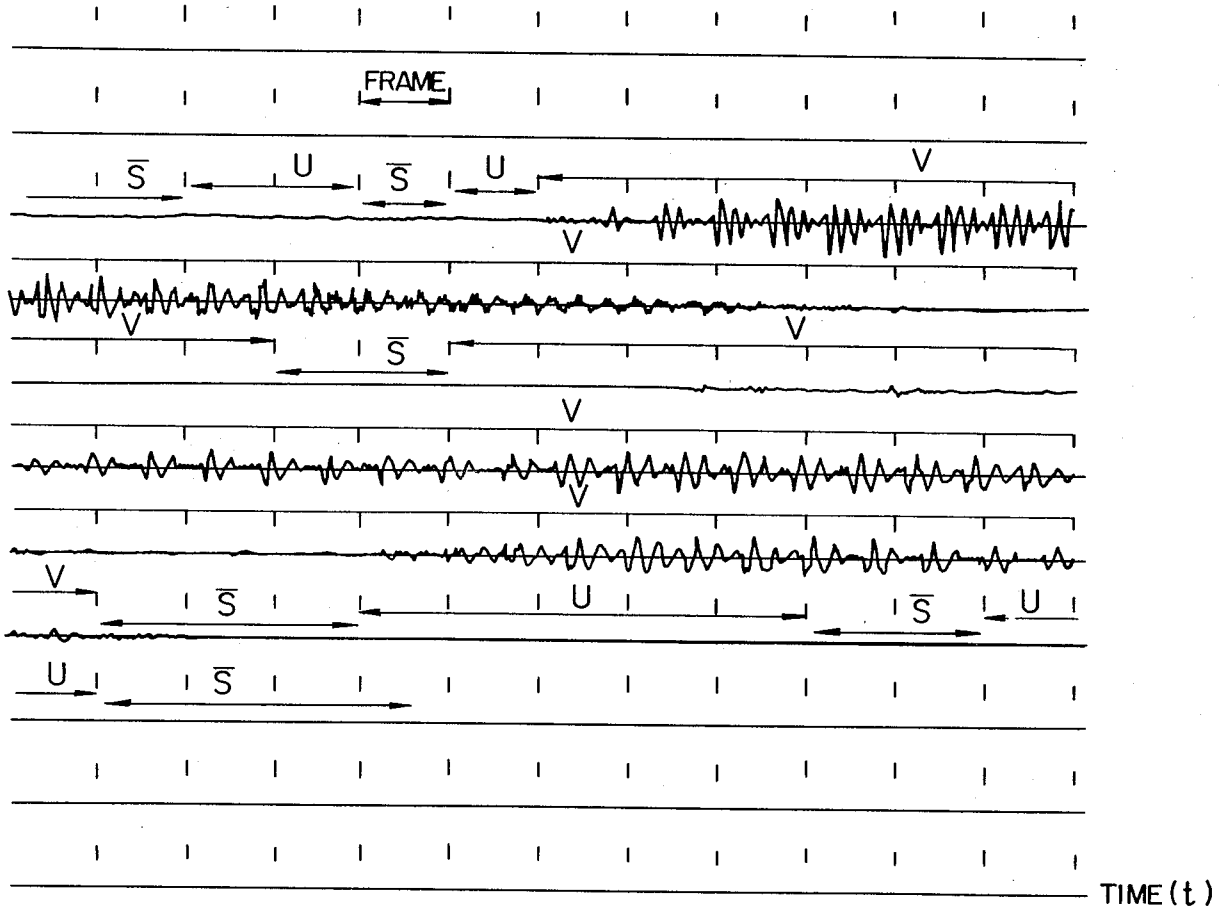
FIGS. 6, *7a*, *7b* and *7c* show examples of the experimental results of speech signal detection and classification according to the present invention.
Figure 7A:
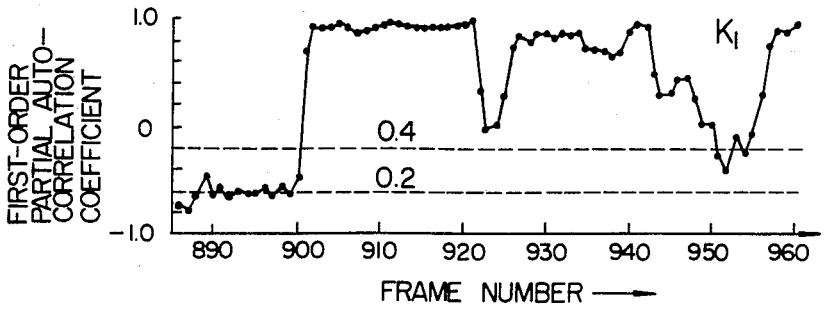
Figure 7B:
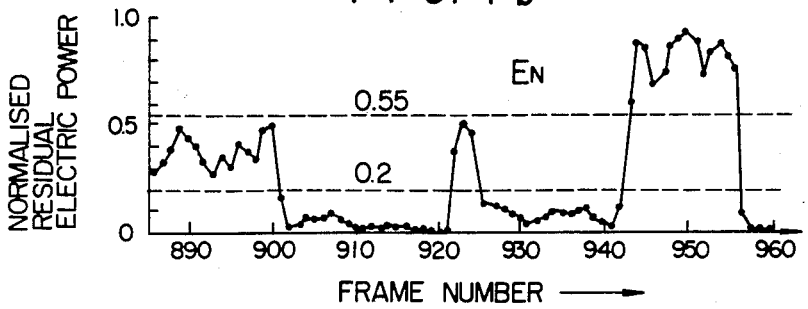
Figure 7C:
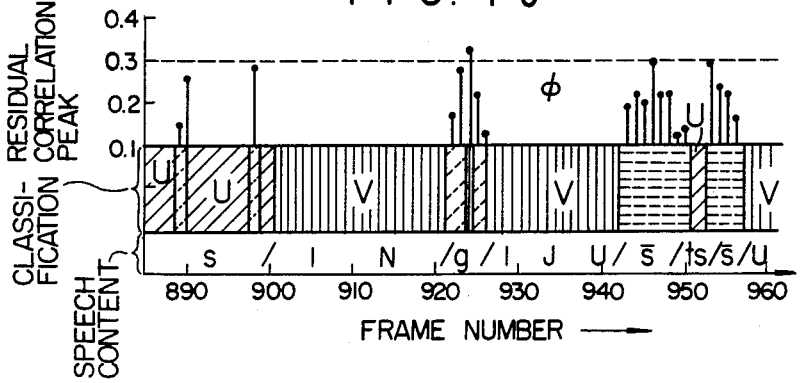

FIG. 6 shows the experimental results when input speech signals (S=U, V or $\bar{S}$) are detected in real time, and each of the detected speech signals (S) is decided or classified (U or V) relative to the time axis t according to the method of the present invention. FIGS. 7a, 7b and 7c show similar results for another speech signal. That is, FIGS. 7a, 7b and 7c illustrate the changes of the three parameters and also the total classification according to the logic shown in FIG. 3. It will be seen from the experimental results that the speech signal detection and subsequent classification are accurate and reliable, and, thus, the method of the present invention is quite effective for speech synthesis or recognition.

It will be understood from the foregoing detailed description of the present invention that detection of a speech signal and decision and classification of voiced and unvoiced sounds included in the speech signal can be accurately and reliably achieved in one frame regardless of a variation of the input signal level. Therefore, the present invention is effective for improving the quality of voice and reducing the error rate in the field of speech analysis, synthesis and transmission of speech and also in the field of speech recognition requiring real-time analysis.

What is claimed is:

1. A method of speech signal detection and classification comprising the steps of:

dividing an input signal into blocks at predetermined intervals having a time period which is sufficient for the detection and the classification of the content of each signal block;

extracting from each of said signal blocks a plurality of normalized parameters, which are relatively independent of level variations of the respective input signal, including a first-order partial auto-correlation coefficient ($K_1$), a normalized residual power ($E_N$) and a peak value of normalized residual correlation ($\phi$); and detecting and classifying said input signal corresponding to each of said signal blocks into a voiced sound (V), an unvoiced sound (U) and silence ($\bar{S}$) by use of preset thresholds corresponding to particular values of the abovesaid normalized parameters that also represent characteristic boundaries for classification of said input signal into the V, U or S type.

2. A method of speech signal detection and classification according to claim 1, wherein said period has a duration of 20–30 milliseconds.

3. A method of speech signal detection and classification according to claim 1, in which $E_N$ has a value between 0 and 1 and $K_1$ has a range between $-1$ and $+1$ and wherein the step of detecting and classifying further includes the steps of:

(a) a voiced sound determination when
(1) $E_N \leqq \alpha_1$, and $K_1 > \beta_2$, or
(2) $E_N > \alpha_1$, $K_1 > \beta_2$ and $\phi > \theta$, or
(3) $E_N \leqq \alpha_1$, $K_1 \leqq \beta_2$ and $\phi > \theta$, or
(4) $\alpha_1 < E_N \leqq \alpha_2$, $\beta_1 < K_1 \leqq \beta_2$ and $\phi > \theta$;

(b) an unvoiced sound determination when
(1) $\alpha_1 < E_N \leqq \alpha_2$, and $K_1 \leqq \beta_1$, or
(2) $E_N \leqq \alpha_1$, $K_1 \leqq \beta_2$ and $\phi \leqq 74$, or
(3) $\alpha_1 < E_N \leqq \alpha_2$, $K_1 > \beta_1$ and $\phi \leqq \theta$; and (c) silence determination when
(1) $E_N > \alpha_2$ and $K_1 \leqq \beta_2$, or
(2) $E_N > \alpha_2$, $K_1 > \beta_2$ and $\phi \leqq \theta$, where $\beta_1$ and $\beta_2$ correspond to said preset threshold values within the range of $E_N$, $\alpha_1$ and $\alpha_2$ correspond to threshold values within the range of $K_1$ and $\theta$ is a preset threshold corresponding to a value of $\phi$ and wherein $\beta_1 < \beta_2$ and $\alpha_1 < \alpha_2$.

4. A method of speech signal detection and classification according to claim 3, wherein the step of detecting and classifying as a voice sound is executed when $\alpha_1 < E_N \leqq \alpha_2$ and $K_1 > \beta_3$, where $\beta_3$ is a threshold value greater than $\beta_2$.

5. A method of speech signal detection and classification according to claim 4, wherein said threshold value $\beta_3$ is approximately 0.93.

6. A method of speech signal detection and classification according to claim 4, wherein $\alpha_1$ and $\alpha_2$ have values of about 0.2 and 0.6, respectively;

$\beta_1$, $\beta_2$ and $\beta_3$ have values of about 0.2, 0.4 and 0.93, respectively; and $\theta$ is about 0.3.

7. A method of speech signal detection and classification according to claim 4, wherein said level variations of said input signal correspond to both its amplitude and its intensity.

8. A method of speech signal detection and classification comprising the steps of:

dividing an input signal into blocks at predetermined intervals having a time period which is sufficient for the detection and the classification of the content of each signal block;

extracting from each of said signal blocks a plurality of normalized parameters, including a first-order partial auto-correlation coefficient ($K_1$), a normalized residual power ($E_N$) and a peak value of normalized residual correlation ($\phi$); and detecting sand classifying said input signal corresponding to each of said signal blocks into a voiced sound (V), an unvoiced sound (U) and silence ($\bar{S}$) by use of preset thresholds corresponding to particular values of the abovesaid normalized parameters that also represent characteristic boundaries for classification of said input signal into the V, U or S type.

9. A method of speech signal detection and classification according to claim 8, wherein said plurality of normalized parameters are relatively independent of the amplitude and intensity of the respective input signal.

* * * * *